United States Patent [19]

Ikegami et al.

[11] 4,237,819

[45] Dec. 9, 1980

[54] IMAGE DEVELOPING MACHINE USING MAGNETIC TONER

[75] Inventors: Masahiro Ikegami; Sennosuke Morikawa, both of Komae; Keitaro Yamashita; Koji Noguchi, both of Kumagaya, all of Japan

[73] Assignee: Tokyo Aircraft Instrument Co., Ltd., Tokyo, Japan

[21] Appl. No.: 917,800

[22] Filed: Jun. 22, 1978

[30] Foreign Application Priority Data

Jun. 29, 1977 [JP] Japan ..... 52-77432

[51] Int. Cl.[3] ..... G03G 15/09

[52] U.S. Cl. ..... 118/658; 118/657

[58] Field of Search ..... 118/658, 657

[56] References Cited

U.S. PATENT DOCUMENTS 4,132,192 1/1979 Weyers et al. ..... 118/658

4,154,520 5/1979 Nishikawa et al. ..... 118/658

FOREIGN PATENT DOCUMENTS 2646166 5/1977 Fed. Rep. of Germany .

*Primary Examiner*—Bernard D. Pianalto

*Attorney, Agent, or Firm*—Spencer & Kaye

[57] ABSTRACT

An image developing machine uses magnetic toner for developing a latent image on a light sensitive drum. The magnetic toner is fed onto a surface of a sleeve and applied onto the surface of the light sensitive drum at a developing station in a direction which is the reverse of the moving direction of the drum. Before being applied, the thickness of the toner on the sleeve is lessened twice by doctor blades so as to effectively avoid any occurrence of sticking between the toner particles or sticking thereof to the sleeve surface. Proper values have been found for the distance H between the drum surface and the sleeve surface and gaps $L_1$ and $L_2$ between leading ends of the doctor blades and the sleeve surface.

4 Claims, 2 Drawing Figures

IMAGE DEVELOPING MACHINE USING MAGNETIC TONER

BACKGROUND OF THE INVENTION

The present invention relates to an image developing machine using magnetic toner, and more particularly to an image developing machine using a magnetic brush comprising magnetic toner in which the magnetic toner is applied to the surface of a light sensitive drum for developing a latent image thereon.

In an image developing process employing a developing machine using magnetic toner in the form of a magnetic brush, the selection of a gap H between the surfaces of the light sensitive drum and a magnetic brush sleeve, the volume of the toner on the surface of the magnetic brush sleeve, and the thickness L of the toner on the sleeve are very important. Unless proper selection is made for these items, good development can not be expected. However, it is not easy to satisfy and stabilize the condition of all components which may affect the quality of the image developed, such as sharpness, resolution and background density.

SUMMARY OF THE INVENTION

It is an object of the present invention to provide an image developing machine using magnetic toner in which the structure of the machine is determined so that desirable values for the respective items are selected, and which always produces good image quality.

Briefly stated, the image developing machine using the magnetic toner according to the present invention includes a sleeve disposed beyond a gap H between a surface of a light sensitive drum rotating in one direction, which applies magnetic toner from its surface to the surface of the light sensitive drum from reverse of the moving direction of the light sensitive drum according to rotation of the sleeve or that of a magnet roller inserted within the sleeve; a first doctor blade disposed against the sleeve keeping a gap of $L_1$ therefrom, which regulates the volume and thickness of the magnetic toner held on the surface of the sleeve; and a second doctor blade disposed against the sleeve keeping a gap $L_2$ therefrom, which further regulates the thickness of the magnetic toner already regulated by the first doctor blade on the surface of the sleeve, values of the above H, $L_1$ and $L_2$ satisfying the following conditions when a magnetic flux density on the sleeve surface is between 700 gauss and 1000 gauss:

$$0.55\ \text{mm} \leqq H \leqq 0.65\ \text{mm}$$

$$L_2 + 0.05\ \text{mm} \leqq L_1 \leqq L_2 + 0.15\ \text{mm}$$

$$0.25\ \text{mm} \leqq L_2 \leqq 0.40\ \text{mm},$$

and similarly between 1000 gauss and 1500 gauss:

$$0.90\ \text{mm} \leqq H \leqq 1.00\ \text{mm}$$

$$L_2 + 0.05\ \text{mm} \leqq L_1 \leqq L_2 + 0.15\ \text{mm}$$

$$0.25\ \text{mm} \leqq L_2 \leqq 0.40\ \text{mm}.$$

With this structure the object of the present invention can be fulfilled.

BRIEF DESCRIPTION OF THE DRAWINGS

A more complete understanding of this invention will be obtained from the detailed description which follows, taken in conjunction with the appended drawings, wherein.

DESCRIPTION OF THE PREFERRED EMBODIMENT

Figure 1:
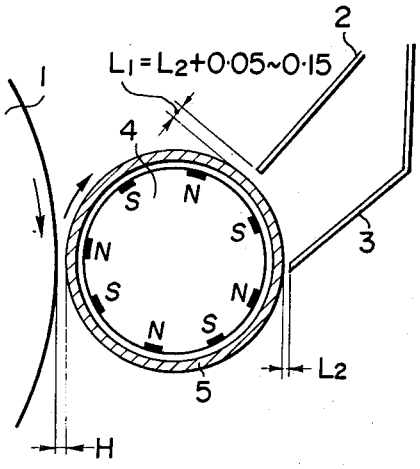
FIG. 1 is a sectional view of an embodiment of the image developing machine using magnetic toner according to the present invention.

In FIG. 1, a light sensitive drum 1, a magnet roller 4 and a sleeve 5 have rotation axes respectively vertical to the paper. In this embodiment, the light sensitive drum 1 rotates in the clockwise direction and the sleeve 5, made of an aluminium or stainless steel alloy, also rotates in the clockwise direction. The shortest distance between the surfaces of the light sensitive drum 1 and the sleeve 5 is designated H. At the position of this shortest distance H, which is the developing station of the latent image, the moving directions of the surfaces of the drum 1 and the sleeve 5 are the reverse of each other. Concentric with the sleeve 5, the magnet roller 4 is disposed and fixed within the sleeve 5. The magnet roller 4 is magnetized multipolarly as shown in the figure. As described above, the rotational direction of the sleeve 5 is opposite the moving direction of the light sensitive drum 1 at the position of the shortest distance H. Therefore, the moving direction of the magnetic toner on the surface of the sleeve 5 at the developing station where the distance between the surfaces of drum 1 and sleeve 5 is equal to H, is reversed with respect to that of drum 1. This relation has been chosen because good result has been obtained in the matter of background density when the toner has been applied from the reverse moving direction rather than the same direction. In place of rotating the sleeve 5, the magnet roller 4 may be rotated in the counterclockwise direction to obtain the same result, that is, to move the toner in the clockwise direction. However, rotation of the sleeve 5 is preferable to rotating the magnet roller 4 in the reverse direction because blocking of the magnetic toner is more efficiently avoided. Further, because the toner revolves around the sleeve 5 and also on it own axis, a rotational speed of one-half or less than the rotational speed required when the magnet roller is rotated suffices in the case of rotation of the sleeve 5.

The thickness of the magnetic toner on the surface of the sleeve 5 is regulated twice according to the present invention by a first doctor blade 2 and a second doctor blade 3. The magnetic toner sticks easily compared with the conventional double component toner consisting of a non-magnetic toner and a magnetic carrier, and may be fixed on the paper by applying pressure. Due to this characteristic, if regulation by a single doctor blade is made only once so as to suddenly lessen the thickness on the surface of the sleeve 5, sticking between the toner particles or sticking thereof to the sleeve surface is apt to occur. According to one embodiment of the invention, the magnetic toner is supplied from a toner hopper, not shown, to supplement the toner transferred onto the surface of the drum 1 in the course of the previous developing process according to the rotation of the drum 1 and the sleeve 5, and the thickness of the toner is at first regulated by the first doctor blade 2 to the thickness of $L_1$ which is 0.05–0.15 mm larger than the regulation value $L_2$ by the second doctor blade 3, which is between 0.25–0.40 mm. As shown in FIG. 1, the leading ends of the respective doctor blades 2 and 3 are sufficiently displaced from the magnetic poles of the magnet roller 4, so as to effectively avoid orientation of the toner by the influence of the poles, and further, blocking caused by the orientation. Thus the thickness of the toner on the surface of the sleeve 5 is finally regulated to the range between 0.25–0.40 mm irrespective of the magnetic flux density on the sleeve surface.

Figure 2:
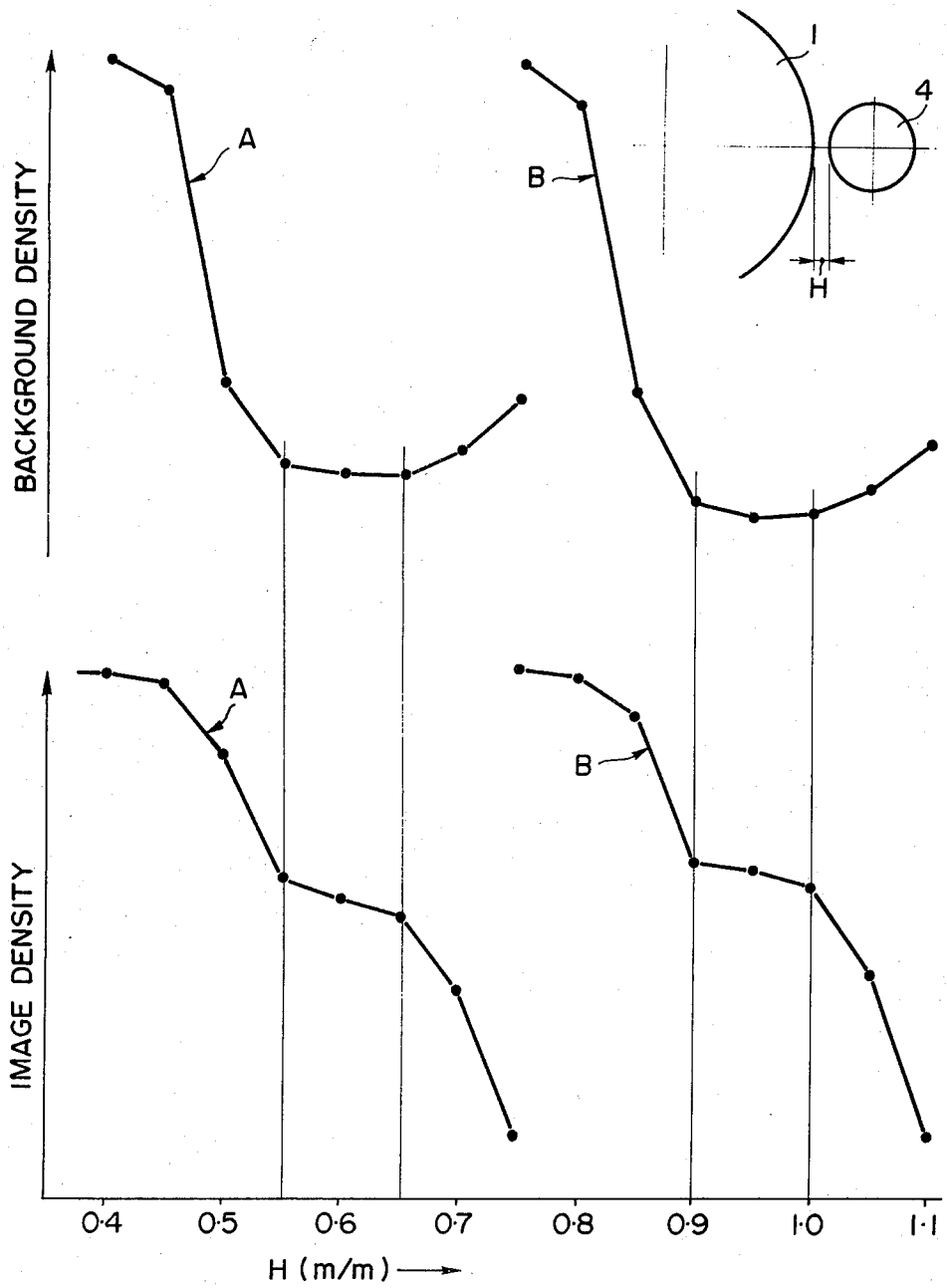
FIG. 2 is a graph of the distance H versus background density and image density.

FIG. 2 is a graph showing the background density and image density versus the distance H between the light sensitive drum 1 and the sleeve 5.

In this figure, lines A show the case where the magnetic flux density on the surface of the sleeve 5 facing a pole of the magnet roller 4 is 800 gauss and the thickness of the toner on the sleeve 5 is 0.35 mm. From the figure it will be realized that the background density is least when the distance H is between 0.55–0.65 mm.

Lines B show characteristics curves in the case when the magnetic flux density on the sleeve surface is 1200 gauss. In this case, the background density is least when H is between 0.9–1.0 mm.

It will be realized that in these ranges in the two cases change of the image density is little and constant image density is obtainable.

By further experiments for various cases, it has been found that when the magnetic flux density on the surface of the sleeve 5 is between 700 and 1000 gauss, good results are obtained for the image quality. That is, image sharpness, resolution and background density are good when the distance H at the developing station, the gaps $L_1$ and $L_2$ between the leading ends of the first and second doctor blades and the sleeve satisfy the following conditions:

$$0.55\ \text{mm} \leqq H \leqq 0.65\ \text{mm}$$

$$L_2+0.05\ \text{mm} \leqq L_1 \leqq L_2+0.15\ \text{mm}$$

$$0.25\ \text{mm} \leqq L_2 \leqq 0.40\ \text{mm}.$$

When the magnetic flux density is between 1000 and 1500 gauss, a good developing result has been obtained with the following range of values of H, $L_1$ and $L_2$:

$$0.90\ \text{mm} \leqq H \leqq 1.00\ \text{mm}$$

$$L_2+0.05\ \text{mm} \leqq L_1 \leqq L_2+0.15\ \text{mm}$$

$$0.25\ \text{mm} \leqq L_2 \leqq 0.40\ \text{mm}.$$

The invention has been described in detail with particular reference to a preferred embodiment thereof, but it will be understood that variations and modifications can be effected within the spirit and scope of the invention.

What we claim is:

1. An image developing machine employing a magnetic toner, comprising:

a magnetic roller having a fixed axis;

a sleeve surrounding said magnetic roller;

a light sensitive drum rotatable in one direction, the surface of said drum being spaced from the surface of said sleeve by a distance H, one of said magnetic roller and sleeve being rotated about said fixed axis to transfer magnetic toner on the surface of said sleeve to said drum, said magnetic toner rotating in the opposite direction from said drum;

a first doctor blade positioned adjacent the surface of said sleeve at a distance $L_1$ therefrom, said first doctor blade regulating the volume and thickness of the magnetic toner on the surface of said sleeve; and a second doctor blade positioned adjacent the surface of said sleeve at a distance $L_2$ therefrom, said second doctor blade further regulating the thickness of the magnetic toner already regulated by said first doctor blade on the surface of said sleeve, the distances H, $L_1$ and $L_2$ having the following values when the magnetic flux density on the surface of said sleeve is between 700 and 1000 gauss:

$$0.55\ \text{mm} \leqq H \leqq 0.65\ \text{mm}$$

$$L_2+0.05\ \text{mm} \leqq L_1 \leqq L_2+0.15\ \text{mm}$$

$$0.25\ \text{mm} \leqq L_2 \leqq 0.40\ \text{mm}.$$

2. An image developing machine using magnetic toner according to claim 1, wherein a leading end of each of the first and second doctor blades is displaced from the position of poles of the magnet roller fixedly inserted within the sleeve.

3. An image developing machine employing a magnetic toner, comprising:

a magnetic roller having a fixed axis;

a sleeve surrounding said magnetic roller;

a light sensitive drum rotatable in one direction, the surface of said drum being spaced from the surface of said sleeve by a distance H, one of said magnetic roller and sleeve being rotated about said fixed axis to transfer magnetic toner on the surface of said sleeve to said drum, said magnetic toner rotating in the opposite direction from said drum;

a first doctor blade positioned adjacent the surface of said sleeve at a distance $L_1$ therefrom, said first doctor blade regulating the volume and thickness of the magnetic toner on the surface of said sleeve; and a second doctor blade positioned adjacent the surface of said sleeve at a distance $L_2$ therefrom, said second doctor blade further regulating the thickness of the magnetic toner already regulated by said first doctor blade on the surface of said sleeve, the distances H, $L_1$ and $L_2$ having the following values when the magnetic flux density on the surface of said sleeve is between 1000 and 1500 gauss:

$$0.90\ \text{mm} \leqq H \leqq 1.00\ \text{mm}$$

$$L_2+0.05\ \text{mm} \leqq L_1 \leqq L_2+0.15\ \text{mm}$$

$$0.25\ \text{mm} \leqq L_2 \leqq 0.40\ \text{mm}.$$

4. An image developing machine using magnetic toner according to claim 3, wherein a leading end of each of the first and second doctor blades is displaced from the position of poles of the magnet roller fixedly inserted within the sleeve.

* * * * *

UNITED STATES PATENT AND TRADEMARK OFFICE

CERTIFICATE OF CORRECTION

PATENT NO. : 4,237,819

DATED : December 9, 1980

INVENTOR(S) : Masahiro Ikegami et al

It is certified that error appears in the above—identified patent and that said Letters Patent is hereby corrected as shown below:

In the heading of the patent, under [75] Inventors, change "Komae" to --Tokyo--; under [73] Assignee, after "Ltd." insert --and Hitachi Metals, Ltd.--.

Column 2, line 47, change "it" to --its--.

Signed and Sealed this

Thirtieth Day of June 1981

[SEAL]

Attest:

RENE D. TEGTMEYER

Attesting Officer

Acting Commissioner of Patents and Trademarks